US011774104B2

(12) United States Patent
Yang et al.

(10) Patent No.: US 11,774,104 B2
(45) Date of Patent: Oct. 3, 2023

(54) GAS OVEN WITH STATIONS UNDER PARALLEL OR SYNCHRONOUS CONTROL

(71) Applicant: JIANGSU JIUHUI TECHNOLOGY CO., LTD., Taizhou (CN)

(72) Inventors: Lanyu Yang, Taizhou (CN); Tao Chen, Taizhou (CN); Xifeng Yang, Taizhou (CN); Jiuhui Bian, Taizhou (CN); Wei Gu, Taizhou (CN); Wenbin Ma, Taizhou (CN); Ming He, Taizhou (CN); Zhengbing Zhu, Taizhou (CN); Xuedan Liu, Taizhou (CN)

(73) Assignee: JIANGSU JIUHUI TECHNOLOGY CO., LTD., Taizhou (CN)

( * ) Notice: Subject to any disclaimer, the term of this patent is extended or adjusted under 35 U.S.C. 154(b) by 373 days.

(21) Appl. No.: 17/161,695

(22) Filed: Jan. 29, 2021

(65) Prior Publication Data

US 2022/0146103 A1 May 12, 2022

Related U.S. Application Data

(63) Continuation of application No. PCT/CN2020/130270, filed on Nov. 20, 2020.

(30) Foreign Application Priority Data

Nov. 9, 2020 (CN) ..... 202011241208.4

(51) Int. Cl.

| | |
|---|---|
| ***F24C 3/12*** | (2006.01) |
| ***F24C 3/00*** | (2006.01) |
| ***F24C 3/02*** | (2021.01) |
| ***F24C 15/16*** | (2006.01) |
| ***F24C 3/08*** | (2006.01) |

(Continued)

(52) U.S. Cl.

CPC ..... *F24C 3/124* (2013.01); *F24C 3/004* (2013.01); *F24C 3/025* (2013.01); *F24C 3/027* (2013.01); *F24C 3/082* (2013.01); *F24C 3/085* (2013.01); *F24C 15/028* (2013.01); *F24C 15/04* (2013.01); *F24C 15/16* (2013.01)

(58) Field of Classification Search

CPC ..... F24C 3/124; F24C 3/085; F24C 3/027; F24C 3/025; F24C 3/004; F24C 15/16; F24C 15/04; F24C 15/028

USPC ..... 126/39 E, 39 R, 39 G

See application file for complete search history.

(56) References Cited

U.S. PATENT DOCUMENTS 8,863,734 B2 * 10/2014 Shaffer ..... A47J 37/0786 126/39 BA

* cited by examiner

*Primary Examiner* — Vivek K Shirsat

(74) *Attorney, Agent, or Firm* — Bayramoglu Law Offices LLC

(57) ABSTRACT

A gas oven with stations under parallel or synchronous control includes a plurality of temperature sensors, a controller and a plurality of processing stations. An air intake device includes a throttle valve, a gas transmission pipeline and a main gas valve. The throttle valve includes a combined gas control unit and a gas valve controller. The air intake device further includes an external gas supply source, and the gas supply source is connected to the gas transmission pipeline and a bakeware. The main gas valve and the throttle valve are separately arranged on the main gas transmission pipeline. The plurality of processing stations are provided with a plurality of gas sub-transmission pipelines and throttle valve gas main transmission pipelines, respectively. The gas oven further includes a communication module connected to a remote control to control the oven by way of a remote terminal or a mobile phone app.

8 Claims, 6 Drawing Sheets

(51) Int. Cl.
*F24C 15/02* (2006.01)
*F24C 15/04* (2006.01)

GAS OVEN WITH STATIONS UNDER PARALLEL OR SYNCHRONOUS CONTROL

CROSS REFERENCE TO THE RELATED APPLICATIONS

This application is a continuation application of International Application No. PCT/CN2020/130270, filed on Nov. 20, 2020, which is based upon and claims priority to Chinese Patent Application No. 202011241208.4, filed on Nov. 9, 2020, the entire contents of which are incorporated herein by reference.

TECHNICAL FIELD

The present invention relates to the technical field of gas ovens, in particular to a gas oven with stations under parallel or synchronous control.

BACKGROUND

Existing gas ovens cook food with a combination of radiant heat and convection heat. An existing gas oven typically includes three parts, wherein the upper part of the gas oven is provided with a top grill that directly grills food with the heat generated by gas combustion, and the lower part of the top grill is provided with an oven that bakes food by heat convection of the heat generated by gas combustion and a charbroiler that bakes fresh food and meat by heat radiation. Moreover, according to the position of the charbroiler, charbroilers can be divided into an upper charbroiler type and a lower charbroiler type.

However, the existing gas ovens with stations under parallel or synchronous control have the following problems:

1. The existing gas ovens with stations under parallel or synchronous control generally cannot be adjusted as needed when turned on, which easily leads to excessive flames and affects the normal use.

2. Since the operating position of the existing gas oven with stations under parallel or synchronous control is not fixed, the smoke may be generated from different positions during use and thus cannot be treated in all aspects, which exerts deleterious effects on users.

3. Gas bottles used for the existing gas ovens with stations under parallel or synchronous control are fixed in a simple manner, and thus may become loosened during use, which poses undesired safety hazards.

4. In the existing gas ovens with stations under parallel or synchronous control, the food that needs to be processed is placed at a single position, which easily leads to contamination of the food and affects human consumption, thereby causing unnecessary waste.

SUMMARY (1) Technical Problems to be Solved

In view of the shortcomings of the prior art, the present invention provides a gas oven with stations under parallel or synchronous control, which solves the problems that gas bottles are fixed in a simple manner, the flames cannot be controlled and adjusted, and the food is placed at a single position.

(2) Technical Solutions

In order to achieve the above-mentioned objective, the present invention provides the following technical solutions. A gas oven with stations under parallel or synchronous control includes a plurality of temperature sensors and a controller. The gas oven includes a plurality of processing stations. An air intake device includes a throttle valve, a gas transmission pipeline and a main gas valve. The throttle valve includes a combined gas control unit and a gas valve controller. The air intake device further includes an external gas supply source, and the gas supply source is connected to the gas transmission pipeline and a bakeware. The main gas valve and the throttle valve are separately arranged on the main gas transmission pipeline.

The plurality of processing stations are provided with a plurality of gas sub-transmission pipelines and throttle valve gas main transmission pipelines, respectively.

The gas oven further includes a communication module connected to a remote control to control the oven by way of a remote terminal or a mobile phone application (app). The controller stores a plurality of menu-type temperature control temperature setting values and controls the plurality of stations through a plurality of throttle valves.

Preferably, a first fixed base is detachably connected to the bottom of a first temperature sensor. A support rod is fixedly connected to the bottom of the first fixed base. The first temperature sensor is fixedly connected to the controller through a connecting wire. The controller is located inside a clamping groove, and the clamping groove is provided on a clamping base. A fixed mount is fixedly connected to the top of the clamping base, and the support rod is fixedly connected to the inside of the fixed mount. A first adjusting block is fixedly connected to a side of the first fixed base. A second fixed base is fixedly connected to the top of the support rod. A second adjusting block is fixedly connected to a side of the second fixed base. A second temperature sensor is detachably connected to the top of the second fixed base, and the second temperature sensor is fixedly connected to the controller through a connecting wire. A heating rack is fixedly connected to a side of the first fixed base, and a placing box is fixedly connected to the bottom of the heating rack. A first heating rod and a second heating rod are fixedly connected to the inside of the heating rack separately. A gas rack is fixedly connected to a side of the heating rack, and a gas bottle is movably connected to the bottom of the gas rack. A fixed plate is fixedly connected to a side of the placing box.

Preferably, a first sliding groove is provided inside the heating rack. A placing plate is slidably connected to the inside of the first sliding groove. A handle is fixedly connected to a side of the placing plate. A fixing hole is provided inside the placing plate.

Preferably, temperature control inside the oven includes a stepwise adjustment and a stepless linear adjustment.

Preferably, the top of the heating rack is provided with a fixed groove, and a movable base is slidably connected to the inside of the fixed groove. A movable rack is fixedly connected to the top of the movable base, and a smoke extraction head is fixedly connected to the inside of the movable rack. A fixed pipe is connected to a side of the movable rack, and a smoke extraction fan is fixedly connected to one end of the fixed pipe.

Preferably, a filter plate is slidably connected to the inside of the smoke extraction fan, a pull groove is provided inside the filter plate, and an air outlet hole is provided on a side of the smoke extraction fan.

Preferably, a groove is provided inside the fixed plate, and a fixed hydraulic rod is fixedly connected to the inside of the groove. A moving rack is fixedly connected to one end of the fixed hydraulic rod, and the moving rack is located beneath the gas bottle.

Preferably, a spring seat is fixedly connected to a side of the fixed plate, a fixed spring rod is fixedly connected to a side of the spring seat, and a fixing clamp is fixedly connected to one end of the fixed spring rod.

Preferably, a drawer groove is provided inside the placing box, and the bakeware is slidably connected to the inside of the drawer groove.

Preferably, a movable door is rotatably connected to the front side of the placing box by a hinge, the front side of the movable door is provided with an arc-shaped groove, and an observation window is installed on the front side of the movable door.

(3) Advantages

Compared with the prior art, the present invention provides a gas oven with stations under parallel or synchronous control, which has the following advantages.

1. The gas oven with stations under parallel or synchronous control is convenient to adjust according to specific needs during use by the first temperature sensor, the controller and the second temperature sensor, thereby avoiding excessive flames to ensure normal use.

2. The gas oven with stations under parallel or synchronous control is convenient for users to adjust according to the actual position of the generated smoke through the fixed groove and the movable base, thereby providing a better operating environment and preventing the smoke from affecting the health of the users.

3. The gas oven with stations under parallel or synchronous control is convenient for users to adjust according to the actual size of the gas bottle through the fixed hydraulic rod and the moving rack, thereby preventing the gas bottle from loosening to avoid causing safety hazards.

4. The gas oven with stations under parallel or synchronous control is convenient for users to place the food to be processed through the bakeware and the drawer groove, thereby avoiding undesired contamination due to the exposure of the food to avoid affecting normal consumption.

In the figures: 1, first temperature sensor; 2, first fixed base; 3, support rod; 4, controller; 5, clamping groove; 6, clamping base; 7, fixed mount; 8, first adjusting block; 9, second fixed base; 10, second adjusting block; 11, smoke extraction head; 12, second temperature sensor; 13, heating rack; 14, placing box; 15, first heating rod; 16, second heating rod; 17, first sliding groove; 18, placing plate; 19, handle; 20, fixing hole; 21, fixed groove; 22, movable base; 23, movable rack; 24, fixed pipe; 25, smoke extraction fan; 26, filter plate 27, pull groove; 28, air outlet hole; 29, gas rack; 30, gas bottle; 31, fixed plate; 32, groove; 33, fixed hydraulic rod; 34, moving rack; 35, spring seat; 36, fixed spring rod; 37, fixing clamp; 38, drawer groove; 39, bakeware; 40, movable door; 41, arc-shaped groove; 42, observation window.

DETAILED DESCRIPTION OF THE EMBODIMENTS

The technical solutions in the embodiments of the present invention will be clearly and completely described hereinafter according to the drawings in the embodiments of the present invention. Obviously, the described embodiments are only a part of the embodiments of the present invention, rather than all the embodiments. Based on the embodiments of the present invention, all other embodiments obtained by those of ordinary skill in the art without creative efforts shall fall within the scope of protection of the present invention.

Embodiments

Figure 1:
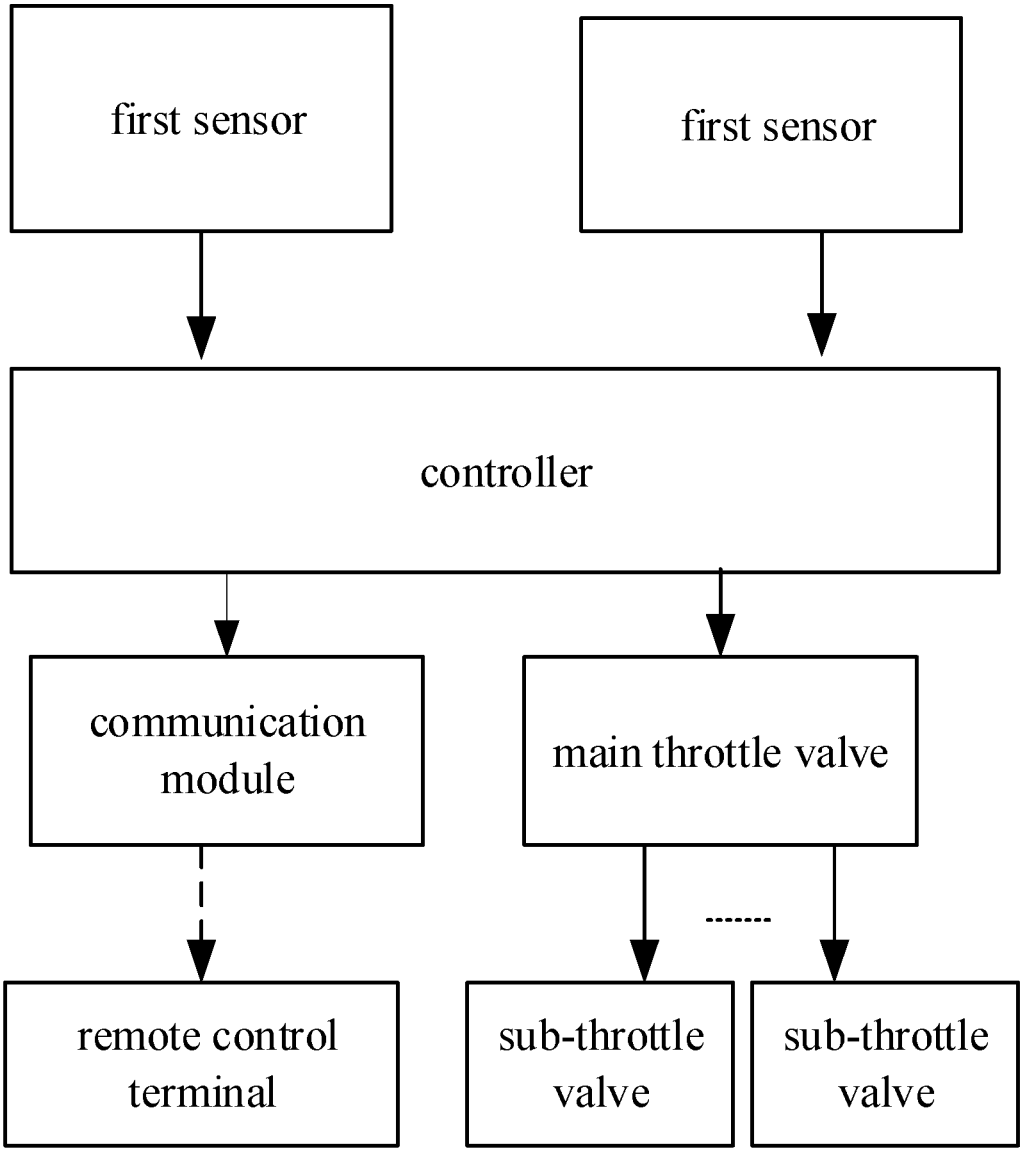
FIG. 1 is a control logic block diagram of the present invention.
Figure 2:
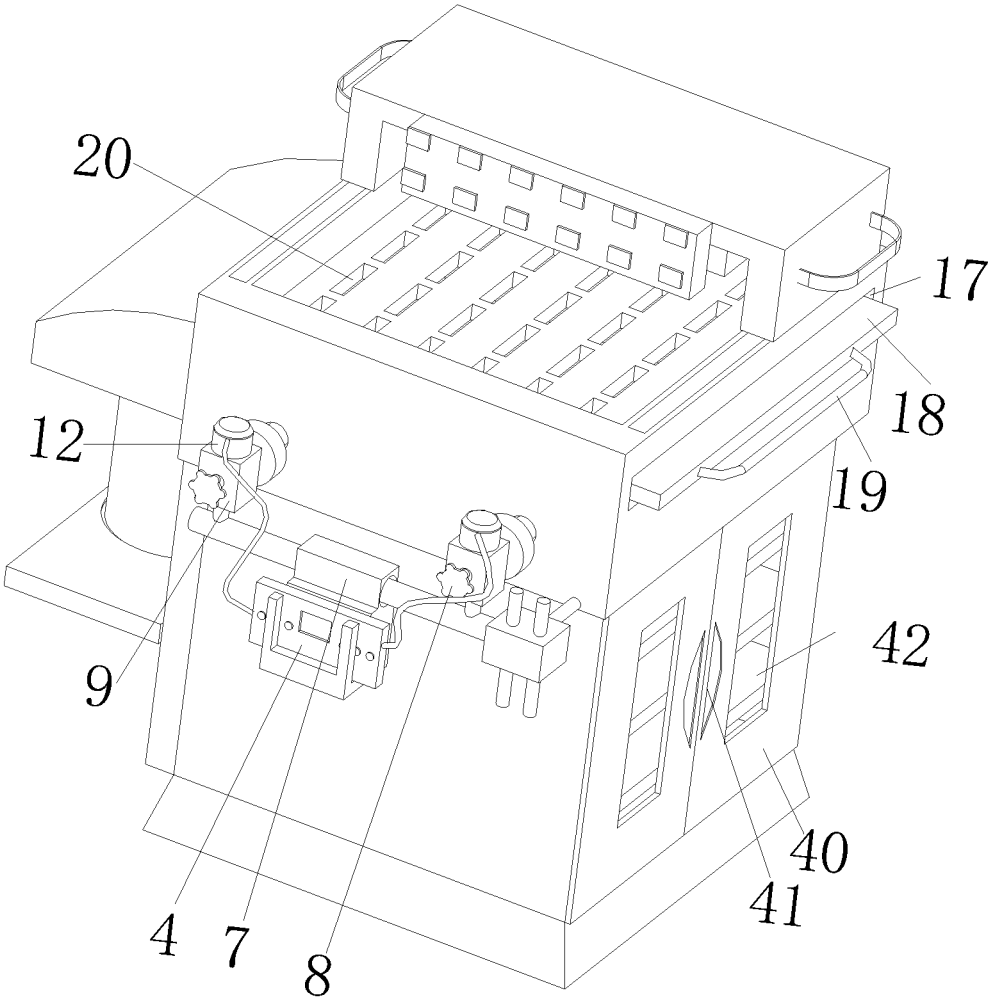
FIG. 2 is a schematic diagram of the structure of the present invention.
Figure 3:
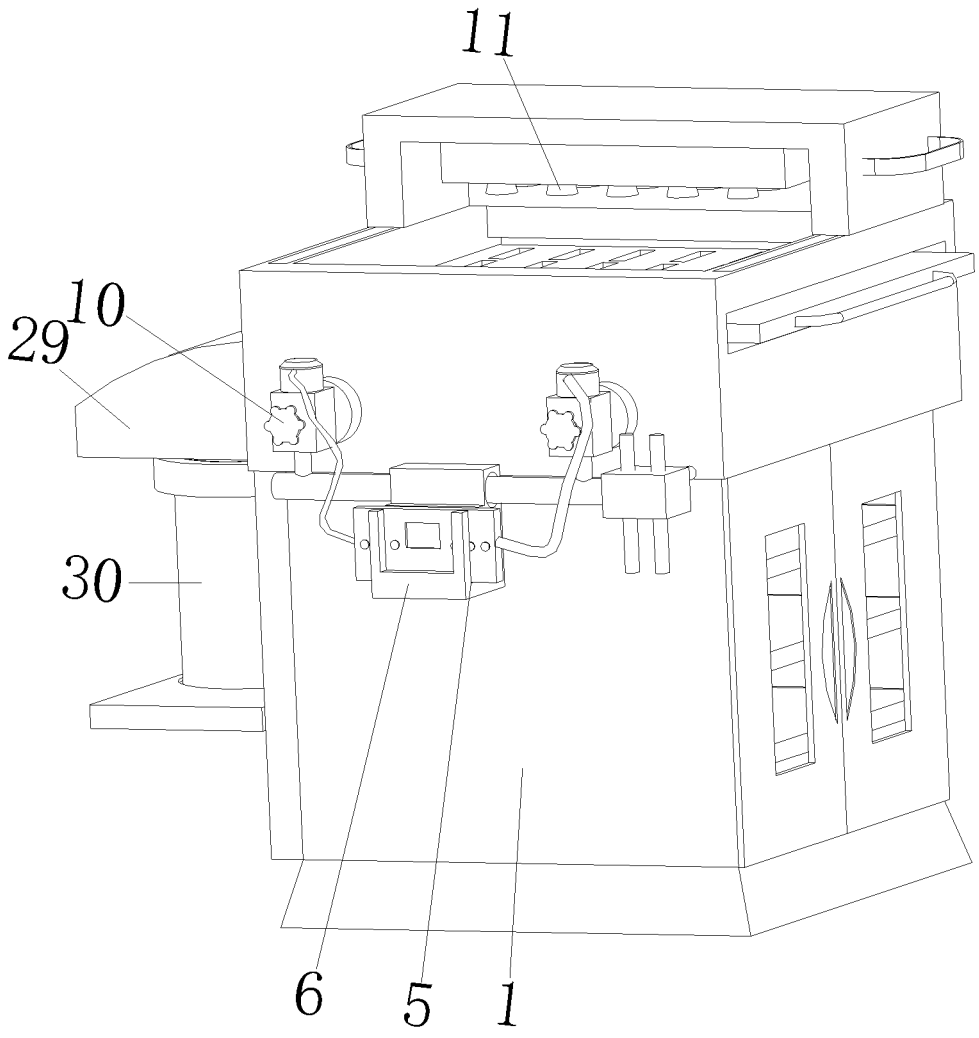
FIG. 3 is a side perspective view of the structure of the present invention.
Figure 4:
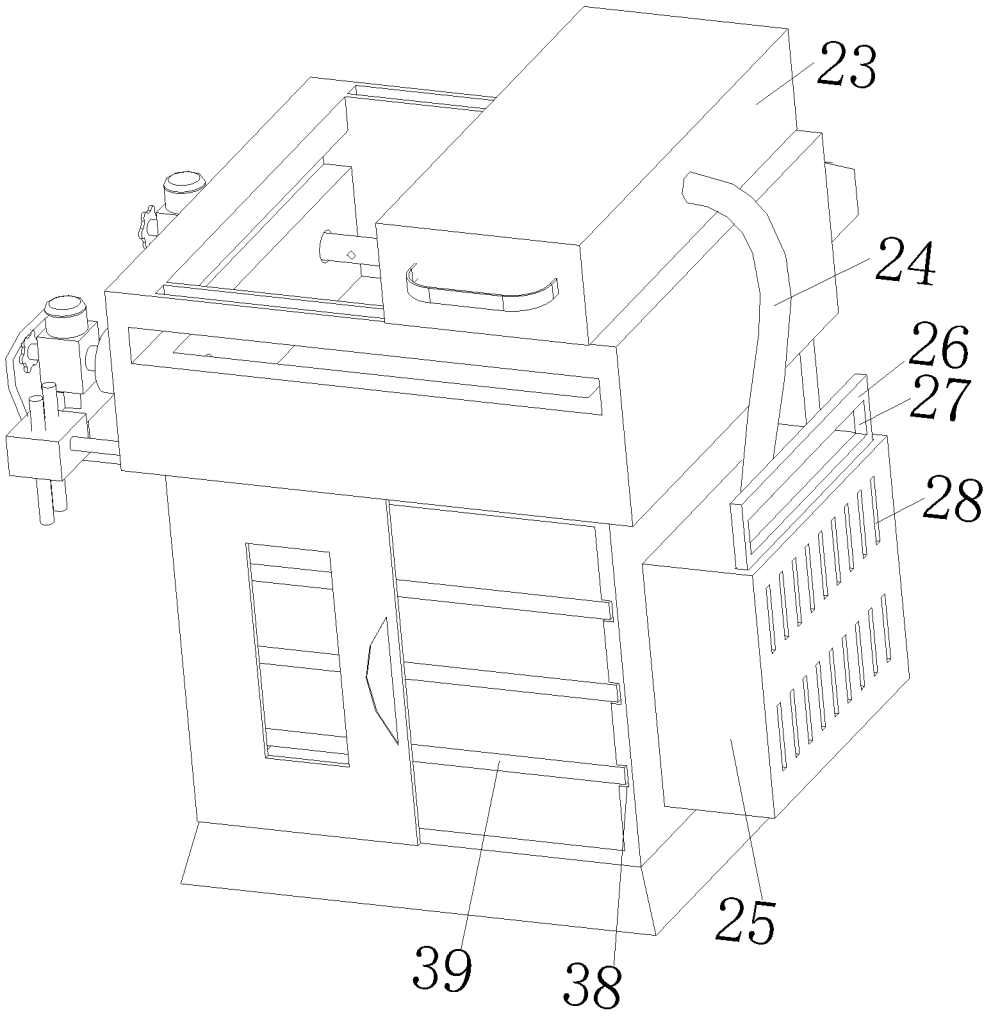
FIG. 4 is a perspective view of the structure of the present invention with a movable door removed.
Figure 5:
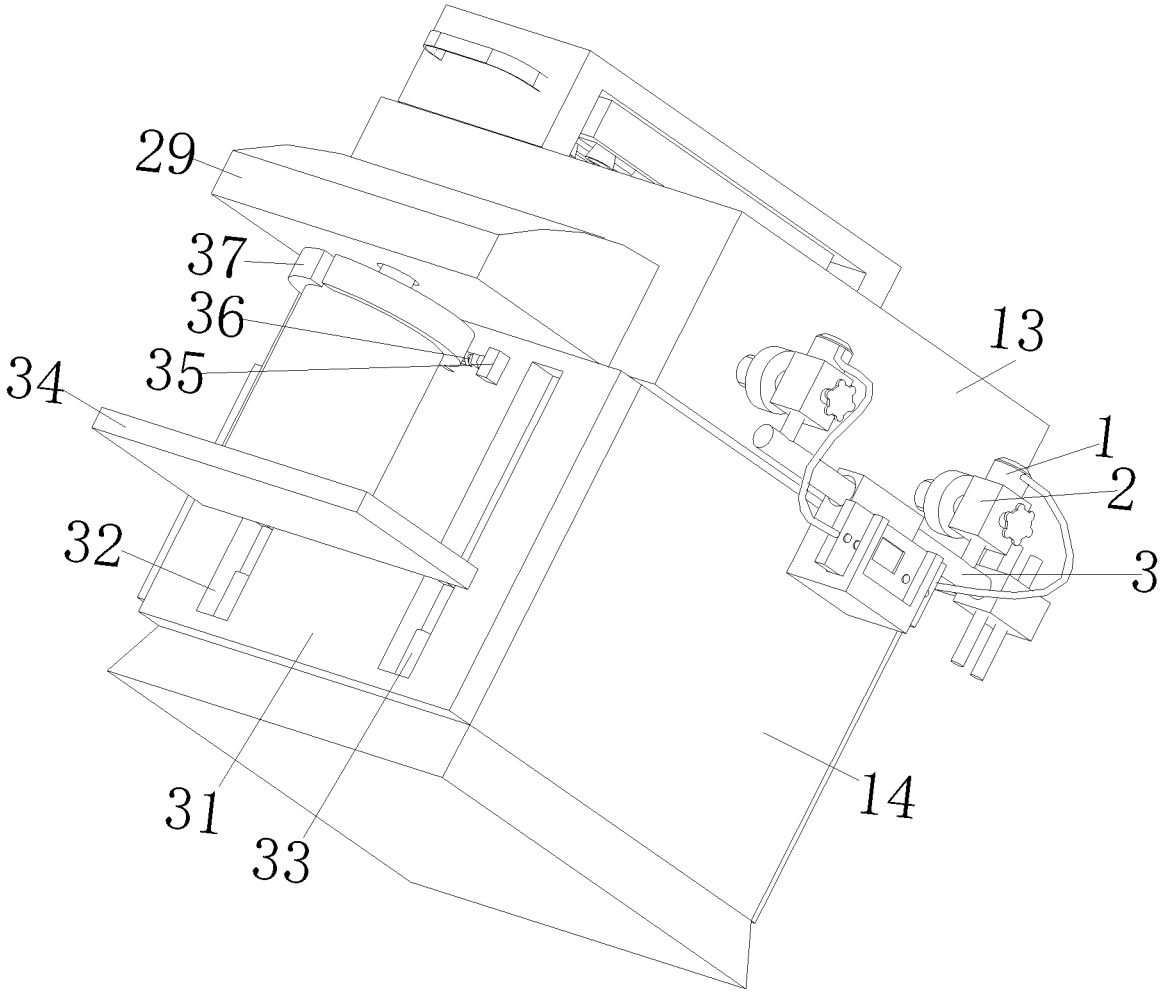
FIG. 5 is a bottom perspective view of the structure of the present invention.
Figure 6:
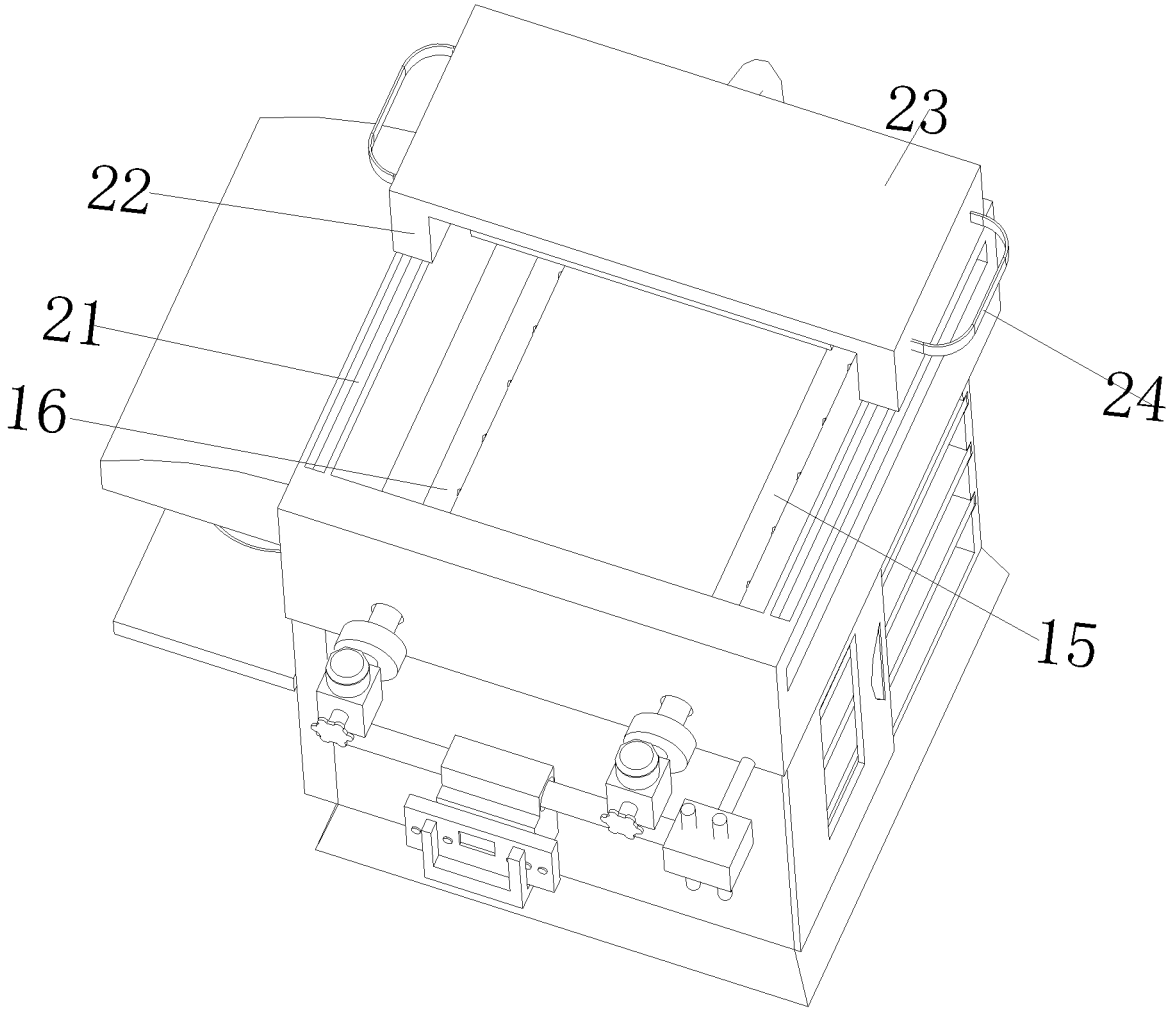
FIG. 6 is a top perspective view of the structure of the present invention.

The present invention provides the following technical solutions. Referring to FIGS. 1-6, a gas oven with stations under parallel or synchronous control includes the first temperature sensor 1, the second temperature sensor 12, and the controller. The gas oven includes a plurality of processing stations. An air intake device includes a throttle valve, a gas transmission pipeline and a main gas valve. The throttle valve includes a combined gas control unit and a gas valve controller. The air intake device further includes an external gas supply source, and the gas supply source is connected to the gas transmission pipeline and the bakeware. The main gas valve and the throttle valve are separately arranged on the main gas transmission pipeline.

The plurality of processing stations are provided with a plurality of gas sub-transmission pipelines and throttle valve gas main transmission pipelines, respectively. The gas oven further includes a communication module connected to a remote control to control the oven by way of a remote terminal or a mobile phone app. The controller stores a plurality of menu-type temperature control temperature setting values and controls the plurality of stations through a plurality of throttle valves.

The first fixed base 2 is detachably connected to the bottom of the first temperature sensor 1. The support rod 3 is fixedly connected to the bottom of the first fixed base 2. The first temperature sensor 1 is fixedly connected to the controller 4 through a connecting wire. The controller 4 is located inside the clamping groove 5, and the clamping groove 5 is provided on the clamping base 6. The fixed mount 7 is fixedly connected to the top of the clamping base 6, and the support rod 3 is fixedly connected to the inside of the fixed mount 7. The first adjusting block 8 is fixedly connected to a side of the first fixed base 2. The second fixed base 9 is fixedly connected to the top of the support rod 3, and the second adjusting block 10 is fixedly connected to a side of the second fixed base 9. The second temperature sensor 12 is detachably connected to the top of the second fixed base 9, and the second temperature sensor 12 is fixedly connected to the controller 4 through a connecting wire. The heating rack 13 is fixedly connected to a side of the first fixed base 2, and the placing box 14 is fixedly connected to the bottom of the heating rack 13. The first heating rod 15 and the second heating rod 16 are fixedly connected to the inside of the heating rack 13 separately. The gas rack 29 is fixedly connected to a side of the heating rack 13, and the gas bottle 30 is movably connected to the bottom of the gas rack 29. The fixed plate 31 is fixedly connected to a side of the placing box 14.

In the present embodiment, the second temperature sensor 12 and the first temperature sensor 1 can be controlled to be turned on by the controller 4, respectively, or can be controlled separately to be turned on. The second temperature sensor 12 and the first temperature sensor 1 are controlled to be turned on by the controller 4 according to the actual needs of users, which is convenient for the users to operate according to the actual needs.

Specifically, the first sliding groove 17 is provided inside the heating rack 13, and the placing plate 18 is slidably connected to the inside of the first sliding groove 17. The handle 19 is fixedly connected to a side of the placing plate 18. The fixing hole 20 is provided inside the placing plate 18.

In the present embodiment, through the pull handle 19 fixedly connected to the side of the placing plate 18 and the pull handle 19 provided inside the placing plate 18, it is convenient for the users to withdraw the placing plate 18 for cleaning, which is user-friendly.

Specifically, the top of the heating rack 13 is provided with the fixed groove 21, and the movable base 22 is slidably connected to the inside of the fixed groove 21. The movable rack 23 is fixedly connected to the top of the movable base 22, and the smoke extraction head 11 is fixedly connected to the inside of the movable rack 23. The fixed pipe 24 is connected to a side of the movable rack 23, and the smoke extraction fan 25 is fixedly connected to one end of the fixed pipe 24.

In the present embodiment, it is convenient for the users to move the position of the movable base 22 by the movable rack 23 fixedly connected to the top of the movable base 22 and the smoke extraction head 11 fixedly connected to the inside of the movable rack 23, to facilitate handling the generated smoke.

Specifically, the filter plate 26 is slidably connected to the inside of the smoke extraction fan 25. The pull groove 27 is provided inside the filter plate 26, and the air outlet hole 28 is provided on a side of the smoke extraction fan 25.

In the present embodiment, the filter plate 26 is slidably connected to the inside of the smoke extraction fan 25, so that the smoke is filtered through the filter plate 26 to avoid environmental pollution.

Specifically, the groove 32 is provided inside the fixed plate 31, and the fixed hydraulic rod 33 is fixedly connected to the inside of the groove 32. The moving rack 34 is fixedly connected to one end of the fixed hydraulic rod 33, and the moving rack 34 is located beneath the gas bottle 30.

In the present embodiment, it is convenient to perform adjustment according to the adopted gas bottle 30 by the fixed hydraulic rod 33 fixedly connected to the inside of the groove 32 and the moving rack 34 fixedly connected to one end of the fixed hydraulic rod 33, which is convenient to operate.

Specifically, the spring seat 35 is fixedly connected to a side of the fixed plate 31, the fixed spring rod 36 is fixedly connected to a side of the spring seat 35, and the fixing clamp 37 is fixedly connected to one end of the fixed spring rod 36.

In the present embodiment, the gas bottle 30 can be securely fixed by the fixed spring rod 36 fixedly connected to the side of the spring seat 35 and the fixing clamp 37 fixedly connected to one end of the fixed spring rod 36.

Specifically, the drawer groove 38 is provided inside the placing box 14, and the bakeware 39 is slidably connected to the inside of the drawer groove 38.

In the present embodiment, it is convenient for the users to place the food to be processed on the bakeware 39 that is slidably connected to the inside of the drawer groove 38, so as to facilitate subsequent use.

Specifically, the movable door 40 is rotatably connected to the front side of the placing box 14 by a hinge, the front side of the movable door 40 is provided with the arc-shaped groove 41, and the observation window 42 is installed on the front side of the movable door 40.

In the present embodiment, it is convenient for the users to open and close the movable door 40 by the arc-shaped groove 41 provided on the front side of the movable door 40, which is user-friendly.

In use, the user pulls the pull handle 19 of the new gas oven and inserts the placing plate 18 into the first sliding groove 17. The food to be processed is placed on the surface of the placing plate 18, and the controller 4 is removed from the clamping groove 5 by hand. The second temperature sensor 12 and the first temperature sensor 1 are separately controlled by the controller 4 to be turned on. The second temperature sensor 12 and the first temperature sensor 1 are controlled by the controller 4 to be turned on according to user preferences. The first heating rod 15 and the second heating rod 16 heat the food on the surface of the placing plate 18 through the first temperature sensor 1 and the second temperature sensor 12 that are turned on. The heat required for processing is controlled by the second fixed base 9 and the first adjusting block 8. Once turned on, the smoke extraction fan 25 extracts the generated smoke into the smoke extraction fan 25 through the fixed pipe 24 by the smoke extraction head 11 inside the movable rack 23, and then the smoke is exhausted through the air outlet hole 28 after being filtered through the filter plate 26 to avoid environmental pollution. The pull groove 27 is convenient for the users to withdraw the filter plate 26 from the inside of the smoke extraction fan 25 for cleaning. The user places the gas bottle 30 on the surface of the moving rack 34 by the fixed hydraulic rod 33, and the fixed hydraulic rod 33 is activated to perform a telescopic movement to drive the gas bottle 30 to move, so that the top of the gas bottle 30 is clamped inside the gas rack 29 to facilitate subsequent use. The fixing clamp 37 clamps the surface of the gas bottle 30 by the telescopic movement of the fixed spring rod 36 to fix the gas bottle 30. The drawer groove 38 is convenient for the users to place food on the surface of the bakeware 39 and slide the food into the placing box 14 through the drawer groove 38, which better protects the food that needs to be processed, and prevents foreign objects from transferring onto the food to avoid contamination of the food and ensure normal use.

Finally, it should be noted that the above descriptions are only preferred embodiments of the present invention and are not used to limit the present invention. Although the present invention has been described in detail with reference to the above embodiments, those skilled in the art can still modify the technical solutions described in the above embodiments, or equivalently replace some of the technical features. Any modification, equivalent replacement, improvement made within the spirit and principle of the present invention shall fall within the scope of protection of the present invention.

What is claimed is:

1. A gas oven with a plurality of processing stations under parallel or synchronous control, comprising a plurality of temperature sensors, a controller and a first fixed base is detachably connected to a bottom of a first temperature sensor, and a support rod is fixedly connected to a bottom of the first fixed base;

the first temperature sensor is fixedly connected to the controller through a first connecting wire;

the controller is located inside a clamping groove, and the clamping groove is provided on a clamping base;

a fixed mount is fixedly connected to a top of the clamping base, and the support rod is fixedly connected to an inside of the fixed mount;

a first adjusting block is fixedly connected to a first side of the first fixed base;

a second fixed base is fixedly connected to a top of the support rod, and a second adjusting block is fixedly connected to a side of the second fixed base;

a second temperature sensor is detachably connected to a top of the second fixed base, and the second temperature sensor is fixedly connected to the controller through a second connecting wire;

a heating rack is fixedly connected to a second side of the first fixed base, and a placing box is fixedly connected to a bottom of the heating rack;

a first heating rod and a second heating rod are fixedly connected to an inside of the heating rack separately;

a gas rack is fixedly connected to a side of the heating rack, and a gas bottle is movably connected to a bottom of the gas rack; and a fixed plate is fixedly connected to a side of the placing box.

2. The gas oven according to claim 1, wherein a first sliding groove is provided inside the heating rack, and a placing plate is slidably connected to an inside of the first sliding groove;

a handle is fixedly connected to a side of the placing plate; and a fixing hole is provided inside the placing plate.

3. The gas oven according to claim 1, wherein a top of the heating rack is provided with a fixed groove, and a movable base is slidably connected to an inside of the fixed groove;

a movable rack is fixedly connected to a top of the movable base, and a smoke extraction head is fixedly connected to an inside of the movable rack; and a fixed pipe is connected to a side of the movable rack, and a smoke extraction fan is fixedly connected to one end of the fixed pipe.

4. The gas oven according to claim 3, wherein a filter plate is slidably connected to an inside of the smoke extraction fan, a pull groove is provided inside the filter plate, and an air outlet hole is provided on a side of the smoke extraction fan.

5. The gas oven according to claim 1, wherein a groove is provided inside the fixed plate, and a fixed hydraulic rod is fixedly connected to an inside of the groove; and a moving rack is fixedly connected to one end of the fixed hydraulic rod, and the moving rack is located beneath the gas bottle.

6. The gas oven according to claim 1, wherein a spring seat is fixedly connected to a side of the fixed plate, a fixed spring rod is fixedly connected to a side of the spring seat, and a fixing clamp is fixedly connected to one end of the fixed spring rod.

7. The gas oven according to claim 1, wherein a drawer groove is provided inside the placing box, and the bakeware is slidably connected to an inside of the drawer groove.

8. The gas oven according to claim 1, wherein a movable door is rotatably connected to a front side of the placing box by a hinge, the front side of the movable door is provided with an arc-shaped groove, and an observation window is installed on the front side of the movable door.

* * * * *